US006561170B2

(12) United States Patent
Almkvist et al.

(10) Patent No.: US 6,561,170 B2
(45) Date of Patent: May 13, 2003

(54) METHOD OF REDUCING EMISSIONS IN THE EXHAUST GASES FROM AN INTERNAL COMBUSTION ENGINE

(75) Inventors: Göran Almkvist, Gråbo (SE); Jan Knutsson, Nödinge (SE); Jan-Erik Larsson, Göteborg (SE); Henrik Magné, Göteborg (SE); Lars Allervåg, Göteborg (SE)

(73) Assignee: Volvo Personvagner AB, Göteborg (SE)

( * ) Notice: Subject to any disclaimer, the term of this patent is extended or adjusted under 35 U.S.C. 154(b) by 59 days.

(21) Appl. No.: 09/842,212

(22) Filed: Apr. 26, 2001

(65) Prior Publication Data

US 2002/0007827 A1 Jan. 24, 2002

(30) Foreign Application Priority Data

Apr. 27, 2000 (SE) ..... 0001532

(51) Int. Cl.[7] ..... F02M 25/07
(52) U.S. Cl. ..... 123/568.14; 123/90.15
(58) Field of Search ..... 123/568.11, 568.14, 123/90.15, 305, 316, 339.16, 339.18

(56) References Cited

U.S. PATENT DOCUMENTS

| | | | | |
|---|---|---|---|---|
| 3,714,932 A | | 2/1973 | Meacham et al. | |
| 4,117,813 A | * | 10/1978 | Yamashita et al. | 123/179.16 |
| 4,561,253 A | * | 12/1985 | Curtil | 123/559.1 |
| 5,233,948 A | | 8/1993 | Boggs et al. | |
| 5,443,050 A | * | 8/1995 | Hitomi et al. | 123/492 |
| 5,531,193 A | | 7/1996 | Nakamura | 123/90.15 |
| 5,622,144 A | | 4/1997 | Nakamura et al. | |
| 6,131,554 A | * | 10/2000 | Ito et al. | 123/184.56 |

FOREIGN PATENT DOCUMENTS

| | | |
|---|---|---|
| DE | 19821217 A | 11/1998 |
| EP | 0828068 A2 | 3/1998 |
| GB | 2274793 A | 8/1994 |
| JP | 60138217 A | 7/1985 |
| JP | 60138218 A | 7/1985 |
| JP | 01159431 A | 6/1989 |

* cited by examiner

*Primary Examiner*—Henry C. Yuen
*Assistant Examiner*—Mahmoud Gimie
(74) *Attorney, Agent, or Firm*—Howrey, Simon, Arnold & White LLP

(57) ABSTRACT

The invention relates to a method of reducing emissions in the exhaust gases from an internal combustion engine that has at least one cylinder to which an air/fuel mixture is supplied when a crankshaft of the internal combustion engine is rotated, at least one inlet valve, at least one inlet duct connecting to the inlet valve, at least one exhaust valve, at least one exhaust duct connecting to the exhaust valve, control members for controlling the opening and closing of the inlet and exhaust valves, and a piston reciprocating between a top dead-center position and a bottom dead-center position in the cylinder. The method comprises the steps of supplying a lean air/fuel mixture to the cylinder, controlling the internal combustion engine so that it works at high load, and controlling the exhaust valve so that it opens when the piston is located in the bottom dead-center position. The exhaust valve is preferably controlled so that it closes after the induction stroke has started. According to one embodiment of the invention, the internal combustion engine is controlled so that the crankshaft rotates at an essentially constant speed within the range of about 1000 to about 2000 rpm.

20 Claims, 2 Drawing Sheets

METHOD OF REDUCING EMISSIONS IN THE EXHAUST GASES FROM AN INTERNAL COMBUSTION ENGINE

CROSS REFERENCE TO RELATED APPLICATIONS

The present application claims priority to Swedish Application SE 0001532-1, filed Apr. 27, 2000.

BACKGROUND OF THE INVENTION

1. Technical Field

The present invention relates to a method of reducing emissions in the exhaust gases from an internal combustion engine having at least one cylinder supplied with an air/fuel mixture when a crankshaft of the internal combustion engine is rotated, at least one inlet valve, at least one inlet duct connecting to the inlet valve, at least one exhaust valve, at least one exhaust duct connecting to the exhaust valve, control members for controlling the opening and closing of the inlet and exhaust valves, and a piston reciprocating between a top dead-center position and a bottom dead-center position in the cylinder.

2. Background Information

It is desirable to reduce the undesirable emissions present in the exhaust gases of an internal combustion engine in order to reduce pollution of the surrounding environment and to satisfy legal requirements for internal combustion engines. The undesirable emissions present in the exhaust gases include, inter alia, carbon monoxide ("CO"), hydrocarbon compounds ("HC") and nitrous oxides ("$NO_x$").

In order to reduce these emissions in the exhaust gases, the engine is provided with a catalytic converter that, by chemical reaction, burns the above mentioned emissions essentially completely. The chemical reaction in the catalytic converter occurs only when the catalytic converter has reached a predetermined working temperature. This working temperature is reached after a predetermined operating time of the engine. As such, when the engine is cold-started and prior to reaching its working temperature, there is no reduction of the above mentioned emissions in the catalytic converter.

There are known arrangements for heating a catalytic converter when the engine is cold-started in order to rapidly reach a desirable working temperature of the catalytic converter, thereby making it possible to reduce engine exhaust gas emissions at an early stage. In one such arrangement, an electric heating element is arranged in the catalytic converter. However, this arrangement makes the catalytic converter complicated and expensive to produce.

One problem with cold-starting internal combustion engines is that a comparatively great amount of fuel in relation to the air supplied, that is to say a rich air/fuel mixture, has to be supplied to the engine in order to start the engine and further so that the engine will be capable of working at an essentially constant speed during idle running. This rich air/fuel mixture is also supplied in order that the engine will be ready to provide increased torque when the accelerator is operated and in order that the engine will be less sensitive to different fuel qualities. The drivability of the engine is thus ensured before the engine has reached its operating temperature.

The absence of emission control in the catalytic converter and the rich air/fuel mixture result in the content of CO, HC and $NO_x$ emitted from the engine being high when the engine is cold-started.

Attempts have previously been made to reduce the quantity of fuel in relation to the air supplied, i.e., run the engine with a leaner air/fuel mixture when the engine is cold-started. These attempts have caused the engine to run rough when idling and negatively affects the drivability of the engine. The reason why the engine speed varies during idle running is that the torque generated by the engine is very sensitive to variations in a lambda value of the air/fuel mixture supplied to the cylinder space of the engine when the air/fuel mixture is lean. The lambda value, or excess air factor, is the actual air quantity supplied divided by the air quantity theoretically necessary for complete combustion. If the lambda value is greater than 1, the air/fuel mixture is lean, and if the lambda value is smaller than 1, the air/fuel mixture is rich.

Fuel supplied from a fuel injection valve can be controlled accurately by the fuel injection system of the engine in order to obtain a substantially constant lambda value for the air/fuel mixture supplied. However, when the engine is cold, fuel will condense on the comparatively cold walls in the inlet duct and in the cylinder. The fuel condensed on the walls will be vaporized and accompany the air/fuel mixture which is flowing in the inlet duct and being supplied to the cylinder space. If there is an uneven vaporization of the fuel condensed on the walls due to, e.g., pressure variations, temperature gradients, or the flow rate of the air/fuel mixture in the inlet duct, the lambda value of the air/fuel mixture supplied to the cylinder space will vary.

As the torque generated by the engine varies during idle running when cold-started, the speed of the engine varies. In this regard, the speed of the engine means the speed of rotation of the crankshaft of the engine. When the speed varies, the pressure in the inlet duct also varies, leading to vaporization of the condensed fuel varying, resulting in a variation of the lambda value of the air/fuel mixture supplied to the cylinder space. This intensifies the uneven speed of the engine.

When fuel supplied to the cylinder comes into contact with the cylinder walls, the fuel condenses. The fuel condensed on the cylinder walls is difficult to ignite during the expansion stroke, resulting in a great quantity of uncombusted fuel that accompanies the exhaust gases. The fuel condensed on the cylinder walls also contributes to the increased formation of HC during the combustion process in the cylinder. This negative effect increases during warming-up of the internal combustion engine, before the engine has reached its working temperature.

At the beginning of this warming-up of the engine, as mentioned above, the catalytic converter has not yet reached its working temperature. This results in the HC emitted reaching an unacceptably high level.

SUMMARY OF THE INVENTION

One object of the present invention is to reduce carbon monoxide, hydrocarbon compounds and nitrous oxides in the exhaust gases from an internal combustion engine when cold-started.

Another object of the present invention is to bring about increased after oxidation of all HC during and after the expansion stroke.

A further object of the present invention is to reach the working temperature of the internal combustion engine as rapidly as possible.

This is achieved by a method for reducing emissions in exhaust gases from an internal combustion engine wherein a lean air/fuel mixture is supplied to the cylinder, the internal combustion engine is controlled so that it works at high load, and the exhaust valve is controlled so that it opens when the piston is located in the bottom dead-center position.

By supplying a lean air/fuel mixture to the cylinder, the total amount of emissions in the exhaust gases emitted from the internal combustion engine is reduced. By controlling the engine so that it works at high load, condensed fuel on the walls of the inlet duct will have little effect on the mixing ratio between the air and the fuel, resulting in the lambda value of the air/fuel mixture supplied to the cylinder space remaining substantially constant. The crankshaft will thus rotate at a substantially constant speed while idling. By controlling the exhaust valve so that it opens when the piston is located in the bottom dead-center position, the expansion and the combustion process will go on substantially throughout the stroke volume of the cylinder. This means that fuel condensed on the cylinder walls during the induction stroke and the compression stroke is afforded the opportunity over a relatively long period of time of being burnt by the fuel flame present in the cylinder during the expansion stroke. At the same time, hydrocarbon compounds formed in the cylinder will also be oxidized during the relatively long combustion process.

BRIEF DESCRIPTION OF THE DRAWINGS

The present invention is explained in greater detail below with reference to an exemplary embodiment shown in the appended drawings, wherein.

DETAILED DESCRIPTION OF THE INVENTION

Figure 1:
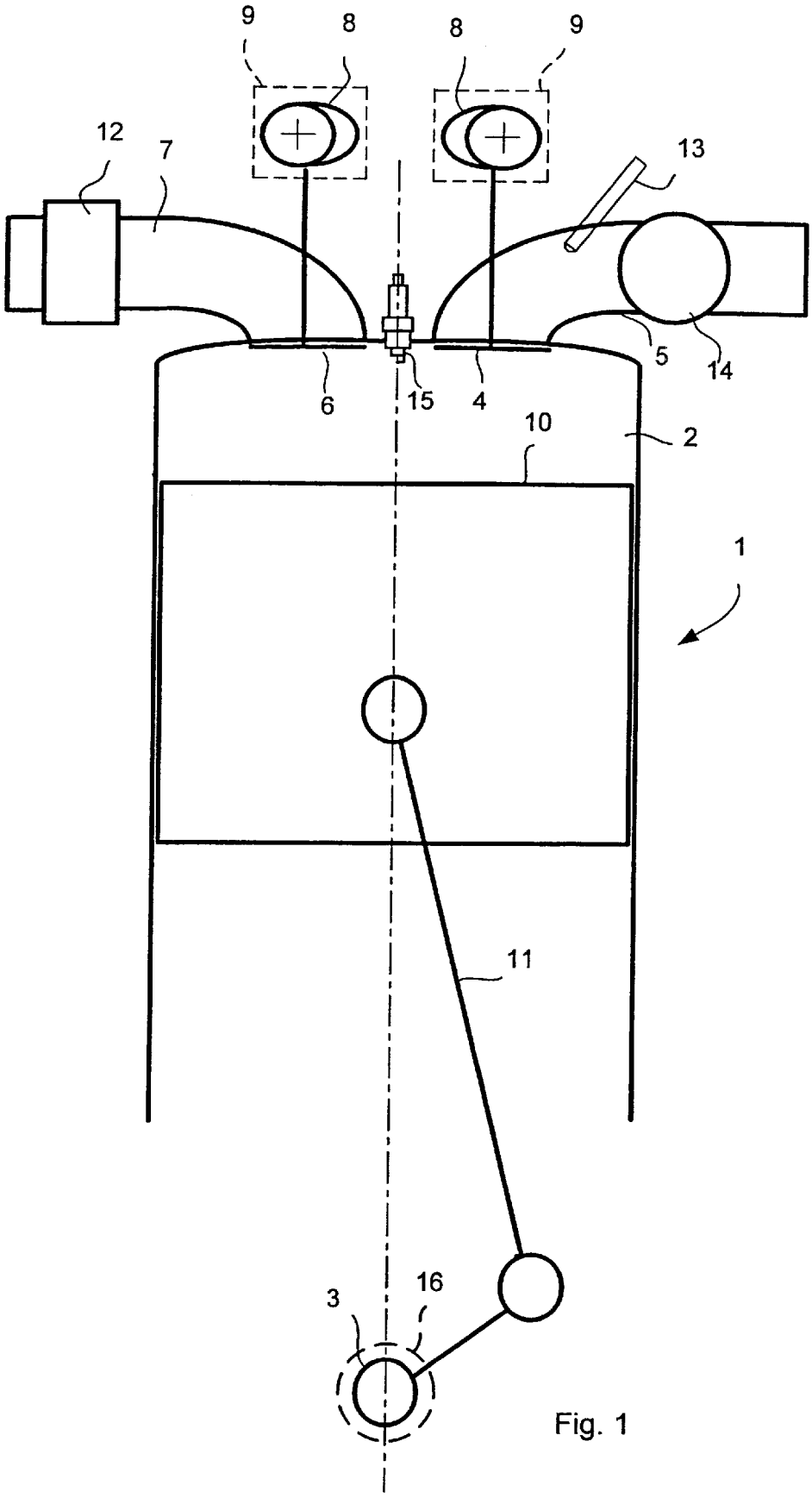
FIG. 1 illustrates a diagram through a portion of an internal combustion engine.

FIG. 1 shows an internal combustion engine 1 having at least one cylinder 2 supplied with an air/fuel mixture when a crankshaft 3 of the engine 1 is rotated. At least one inlet valve 4 is arranged to open and close inlet ducts 5 connected to the cylinder 2 and through which an air/fuel mixture is supplied when the engine 1 is working. At least one exhaust valve 6 is arranged to open and close exhaust ducts 7 connected to the cylinder 2 and through which burnt fuel in the form of exhaust gases is removed when the engine 1 is working. The engine 1 also has control members 8 arranged to control the opening and closing of the inlet and exhaust valves 4, 6. In the exemplary embodiment shown in FIG. 1, the control members 8 consist of camshafts which are preferably mechanically or electronically adjustable so that the time of opening and closing of the inlet and exhaust valves 4, 6 can be varied. This is brought about by, for example, a regulating arrangement 9 shown diagrammatically in FIG. 1 that, in a known manner, rotates the camshafts hydraulically. Other control members 8 are also possible, such as electromagnetically controlled valves. A piston 10, which reciprocates between a top and a bottom dead-center position in the cylinder 2, is mounted on the crankshaft 3 by a connecting rod 11. The engine 1 is preferably of the multi-cylinder type. Fuel is supplied through an injection nozzle 13 arranged in the inlet duct 5. The fuel is injected into the inlet duct 5 in the direction of the inlet valve 4 and the cylinder 2. However, it is possible to arrange the injection nozzle 13 directly in the cylinder 2. A spark plug 15 is arranged to ignite the air/fuel mixture in the cylinder 2. FIG. 1 shows the valves 4, 6 in a closed position.

An exhaust turbo or a mechanical compressor 14 can be coupled to the inlet duct 5 of the engine 1. In the case of a supercharged engine 1, energy is supplied from the compressor or the turbo 14 so that the combustion temperature after the expansion in the cylinder 2 increases. This means that a catalytic converter 12 coupled to the engine 1 can be heated rapidly when the engine 1 is cold-started.

The exhaust turbo or the compressor 14 also brings about a positive pressure in the inlet duct 5, resulting in an increased pressure difference between the pressure in the cylinder 2, immediately before the inlet valve 4 opens, and the pressure in the inlet duct 5.

Figure 2:
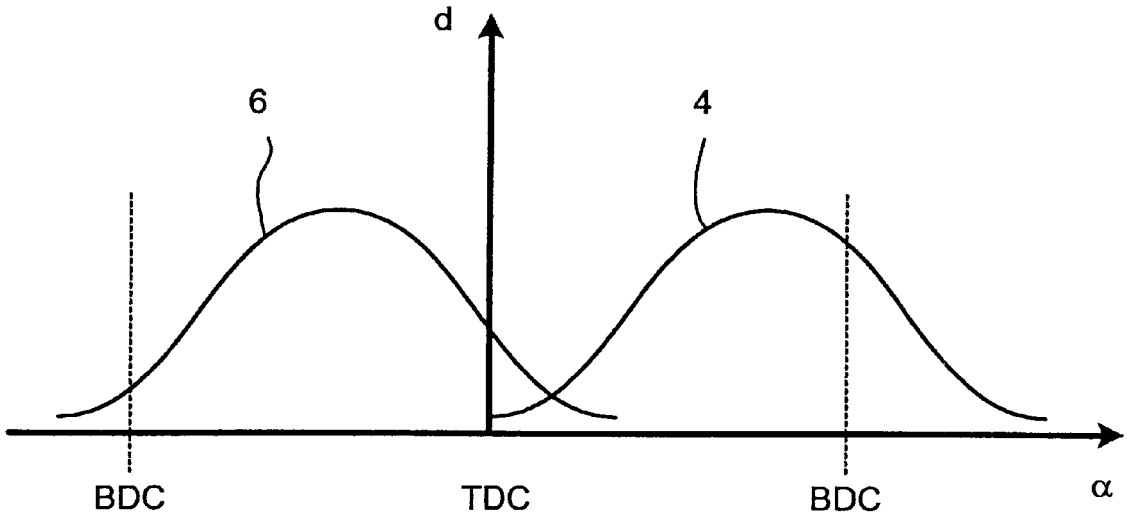
FIG. 2 illustrates a graph of the opening and closing times of the inlet valve and the exhaust valve.

An exemplary embodiment of the method according to the present invention is shown in FIG. 2, which shows a valve lift diagram of the opening and closing times of both inlet and exhaust valves 4, 6. The horizontal axis relates to the crankshaft angle $\alpha$ and the vertical axis relates to the lift height d of the respective valve 4, 6. The origin has been placed at the crankshaft angle $\alpha$ when the piston 10 is located in the top dead-center position TDC on the horizontal axis. The position of the crankshaft angles $\alpha$ when the piston 10 is located in the bottom dead-center positions BDC is also indicated in FIG. 2. During the induction stroke, an air/fuel mixture with a lambda value greater than 1 is supplied to the cylinder 2. The lambda value lies principally within the range of about 1.0 to about 1.4, and preferably within the range of about 1.05 to about 1.2. The content of CO, HC and $NO_x$ in the exhaust gases depends on, inter alia, the mixing ratio of the air/fuel mixture supplied to the cylinder 2. Other factors having an effect on the emissions emitted in the exhaust gases are rate of combustion and temperature during the combustion process, and also how complete the combustion is during the combustion process. The mixing ratio between air and fuel is usually indicated by the lambda value. The aim is to supply a lean air/fuel mixture when the engine is cold so that the content of CO, HC and $NO_x$ emitted from the engine 1 in the form of exhaust gases is low. The hydrocarbon compounds decrease when the air/fuel mixture is lean because oxygen is available for combustion of substantially all the remaining fuel during the combustion process in the cylinder.

Ignition of the air/fuel mixture supplied to the cylinder 2 is carried out at a crankshaft angle of about 10° before to about 30° after the top dead-center position, preferably at a crankshaft angle of about 0° before to about 20° after the top dead-center position. The engine 1 is thus controlled so that it works at high load. This is because the shifted ignition time enables the power of the engine 1 to also control the engine 1 so that it works at high load. This is accomplished by connecting an external load to the engine 1 such as a generator 16, shown diagrammatically by dashed lines in FIG. 1. The engine 1 can also be controlled to work at high load by returning exhaust gases to the cylinder 2, thereby reducing the degree of air filling. When the engine 1 is working at high load, the engine 1 is controlled so that the pressure in the inlet duct 5 is relatively high. This results in the engine 1 being less sensitive to the pressure variations in the inlet duct 5 that occur when the inlet valve 4 opens and closes, described in greater detail below.

The method according to the invention also means that the exhaust valve 6 is controlled so that it opens when the piston 10 is located in the bottom dead-center position. In this regard, locating the piston 10 in the bottom dead-center position means that the piston 10 may be located in an area before and after the bottom dead-center position. According to one embodiment of the invention, shown in FIG. 2, the exhaust valve 6 is controlled so that it opens at a crankshaft angle of about 120° to about 220° after the top dead-center position, preferably at a crankshaft angle of about 140° to about 180° after the top dead-center position. By controlling the exhaust valve 6 so that it opens when the piston 10 is located in the bottom dead-center position, the expansion and the combustion process will continue substantially throughout the stroke volume of the cylinder 2. This means that fuel condensed on the cylinder walls during the induction stroke and the compression stroke is afforded the opportunity over a relatively long period of time of being burnt by the flame present in the cylinder 2 relatively late during the expansion stroke. At the same time, hydrocarbon compounds formed in the cylinder 2 will also be oxidized during the relatively long combustion process. When the exhaust valve 6 is opened, heat generated in the cylinder 2 during the combustion process decreases rapidly, substantially ending the abovementioned favorable effects. Nevertheless, oxidation of hydrocarbon compounds can continue in the exhaust duct 7.

As can be seen from FIG. 2, the exhaust valve 6 is controlled so that it closes after the induction stroke has started. A quantity of exhaust gases is therefore returned to the cylinder 2 and mixed with air freshly supplied from the inlet duct 5 and injected fuel. The returned exhaust gases result in the combustion rate of the fuel/air mixture decreasing, leading to reduced maximum pressure and later combustion in the cylinder 2. The generation of $NO_x$ is thus reduced. The quantity of exhaust gases returned to the cylinder 2 contains uncombusted fuel and HC that will be burnt during the next expansion in the cylinder 2. A delayed combustion is also obtained by virtue of a large area of the cylinder being exposed to the flame while the piston moves downwards in the cylinder. Fuel present on the cylinder wall will then be burnt.

The exhaust valve 6 is preferably controlled so that it closes at a crankshaft angle of about 20° to about 30° after the top dead-center position. However, it is possible to apply the method according to the invention if the exhaust valve 6 is controlled so that it closes at a crankshaft angle of about 0° to about 40° after the top dead-center position when the induction stroke has started. These closing times of the exhaust valve 6 result in exhaust gases from the exhaust duct 7 being returned to the cylinder 2.

In order that the operation of the engine 1 does not run rough when a lean air/fuel mixture is supplied, the inlet valve 4 is preferably controlled so that it opens after the piston 10 has passed the top dead-center position. By controlling the inlet valve 4 so that it opens at a crankshaft angle of about 10° to about 45° after the top dead-center position, preferably about 20° to about 30° after the top dead-center position, when the induction stroke has started, exhaust gases are prevented from flowing into the inlet duct 5. Pressure and temperature variations that occur in the inlet duct 5 can thus be reduced. At the crankshaft angles indicated above, the inlet valve 4 will be sufficiently open for the air/fuel mixture to be allowed to flow into the cylinder 2. If exhaust gases were to flow into the inlet duct 5, it would affect the vaporization of fuel condensed on the walls of the inlet duct 5, which would lead to a change in torque of the crankshaft 3 of the engine 1, and thus uneven operation of the engine 1. In this regard, crankshaft angle means the angle through which the crankshaft 3 has rotated since the piston 10 was located in the top dead-center position. When the piston 10 is located in the top dead-center position, the crankshaft angle is therefore zero.

According to one embodiment of the invention, fuel can be injected into the inlet duct 5 before the inlet valve 4 opens in combination with a negative pressure occurring in the cylinder before the inlet valve opens. This leads to fuel, together with the inlet air, being supplied to the cylinder 2 at very great speed. The fuel is thus atomized and mixed with the inlet air, leading to a homogeneous fuel/air mixture in the cylinder 2.

The engine 1 is preferably controlled so that the crankshaft 3 rotates at a substantially constant speed within the range of about 1000 to about 2000 revolutions per minute (rpm), meaning that a great many working cycles per unit of time are obtained. This, in turn, leads to a great amount of energy per unit of time in the form of heat being supplied to the catalytic converter 12, resulting in rapid heating of the catalytic converter 12 and the engine 1.

While there has been disclosed effective and efficient embodiments of the invention using specific terms, it should be well understood that the invention is not limited to such embodiments as there might be changes made in the arrangement, disposition, and form of the parts without departing from the principle of the present invention as comprehended within the scope of the accompanying claims.

What is claimed is:

1. A method of reducing emissions in exhaust gases from an internal combustion engine having at least one cylinder to which an air/fuel mixture is supplied when a crankshaft of said engine is rotated, at least one inlet valve, at least one inlet duct connecting to said inlet valve, at least one exhaust valve, at least one exhaust duct connecting to said exhaust valve, control members for controlling the opening and closing of said inlet and exhaust valves, and a piston reciprocating between a top dead-center position and a bottom dead-center position in said cylinder, comprising the steps of:

supplying a lean air/fuel mixture to said cylinder, controlling said engine so that it works at high load, controlling said exhaust valve so that it opens when said piston is located in said bottom dead-center position, and wherein said steps are performed when said engine is operating in a cold-start condition.

2. The method according to claim 1 wherein said exhaust valve is controlled so that it opens at a crankshaft angle of about 120 to about 220° after said top dead-center position.

3. The method according to claim 2 wherein said exhaust valve is controlled so that it opens at a crankshaft angle of about 140° to about 180° after said top dead-center position.

4. The method according to claim 1 wherein said exhaust valve is controlled so that it closes after said induction stroke has started.

5. The method according to claim 1 wherein said exhaust valve is controlled so that it closes at a crankshaft angle of about 0° to about 40° after said top dead-center position when said induction stroke has started so that exhaust gases from said exhaust duct are returned to said cylinder.

6. The method according to claim 5 wherein said exhaust valve is controlled so that it closes at a crankshaft angle of about 20° to about 30° after said top dead-center position when said induction stroke has started so that exhaust gases from said exhaust duct are returned to said cylinder.

7. The method according to claim 1 wherein said inlet valve is controlled so that it opens after said induction stroke has started.

8. The method according to claim 1 wherein said inlet valve is controlled so that it opens at a crankshaft angle of about 10° to about 45° after said top dead-center position when said induction stroke has started.

9. The method according to claim 8 wherein said inlet valve is controlled so that it opens at a crankshaft angle of about 20° to about 30° after said top dead-center position when said induction stroke has started.

10. The method according to claim 1 wherein the internal combustion engine is controlled so that the crankshaft rotates at an essentially constant speed within the range of about 1000 to about 2000 rpm.

11. The method according to claim 1 wherein an exhaust turbo or a compressor brings about a positive pressure in the inlet duct.

12. The method according to claim 1 wherein ignition of the air/fuel mixture supplied to the cylinder is carried out at a crankshaft angle of about 10° before to about 30° after the top dead-center position.

13. The method according to claim 12 wherein ignition of the air/fuel mixture supplied to the cylinder is carried out at a crankshaft angle of about 0° to about 20° after the top dead-center position.

14. The method according to claim 1 wherein the lambda value of the air/fuel mixture combusted during the expansion stroke lies principally within the range of about 1.0 to about 1.4.

15. The method according to claim 14 wherein the lambda value of the air/fuel mixture combusted during the expansion stroke lies principally within the range of about 1.05 to about 1.2.

16. The method according to claim 1 wherein the method is used principally when cold-starting the internal combustion engine.

17. The method according to claim 1 wherein the control members for controlling the opening and closing of the inlet and exhaust valves are adjustable, so that the time of opening and closing of the inlet and exhaust valves can be varied.

18. The method according to claim 1 wherein fuel is supplied to the inlet duct before the inlet valve opens.

19. A method of reducing emissions in exhaust gases from an internal combustion engine having at least one cylinder to which an air/fuel mixture is supplied when a crankshaft of said engine is rotated, at least one inlet valve, at least one inlet duct connecting to said inlet valve, at least one exhaust valve, at least one exhaust duct connecting to said exhaust valve, control members for controlling the opening and closing of said inlet and exhaust valves, and a piston reciprocating between a top dead-center position and a bottom dead-center position in said cylinder, comprising the steps of:

supplying a lean air/fuel mixture to said cylinder, controlling said engine so that it works at high load, controlling said exhaust valve so that it opens when said piston is located in said bottom dead-center position, and wherein said inlet valve is controlled so that it opens after said induction stroke has started.

20. A method of reducing emissions in exhaust gases from an internal combustion engine having at least one cylinder to which an air/fuel mixture is supplied when a crankshaft of said engine is rotated, at least one inlet valve, at least one inlet duct connecting to said inlet valve, at least one exhaust valve, at least one exhaust duct connecting to said exhaust valve, control members for controlling the opening and closing of said inlet and exhaust valves, and a piston reciprocating between a top dead-center position and a bottom dead-center position in said cylinder, comprising the steps of:

supplying a lean air/fuel mixture to said cylinder, controlling said engine so that it works at high load, controlling said exhaust valve so that it opens when said piston is located in said bottom dead-center position, and wherein the internal combustion engine is controlled so that the crankshaft rotates at an essentially constant speed within the range of about 1000 to about 2000 rpm.

* * * * *